US009553410B2

(12) United States Patent
Zhao et al.

(10) Patent No.: US 9,553,410 B2
(45) Date of Patent: Jan. 24, 2017

(54) WATERPROOF ELECTRICAL CONNECTOR

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/942,965

(22) Filed: Nov. 16, 2015

(65) Prior Publication Data

US 2016/0141792 A1 May 19, 2016

(30) Foreign Application Priority Data

Nov. 14, 2014 (CN) ..... 2014 2 0677009 U

(51) Int. Cl.

*H01R 13/52* (2006.01)
*H01R 13/6581* (2011.01)
*H01R 12/72* (2011.01)
*H01R 13/6594* (2011.01)

(52) U.S. Cl.

CPC ..... *H01R 13/6581* (2013.01); *H01R 12/724* (2013.01); *H01R 13/5216* (2013.01); *H01R 13/6594* (2013.01)

(58) Field of Classification Search

CPC . H01R 13/52; H01R 13/5202; H01R 13/5205; H01R 13/5219; H01R 13/5221; H01R 13/6594

USPC ..... 439/271, 587, 607.35, 660

See application file for complete search history.

(56) References Cited

U.S. PATENT DOCUMENTS 8,262,414 B1 * 9/2012 Li ..... H01R 13/6273 439/607.35
8,348,688 B2 * 1/2013 Liu ..... H01R 13/5219 439/271
8,662,928 B1 * 3/2014 Xie ..... H01R 13/6594 439/607.35
8,801,463 B2 * 8/2014 Tan ..... H01R 13/5202 439/607.04
9,112,299 B2 * 8/2015 Lu ..... H01R 13/5227
9,160,098 B1 * 10/2015 Liao ..... H01R 13/5202
9,178,319 B2 * 11/2015 Little ..... H01R 13/6585
9,281,608 B2 * 3/2016 Zhao ..... H01R 12/57

(Continued)

FOREIGN PATENT DOCUMENTS

CN 203871583 10/2014

*Primary Examiner* — Hae Moon Hyeon

(74) *Attorney, Agent, or Firm* — Wei Te Chung; Ming Chieh Chang

(57) ABSTRACT

An electrical connector, mounted upon a printed circuit board, includes an insulative housing, a number of terminals disposed in the insulative housing, a shielding shell attached to the housing, and a glue wall formed by glue. The housing defines a third base portion and a groove located at an upper surface in a rear end and for receiving glue. The terminals has a number of first contacts and a number of second contacts. Each first contact has a first soldering portion and each second contact has a second soldering portion. The shielding shell defines a guiding hole for flowing the glue. The glue wall flows from the guiding hole through the groove to seal up a gap between the insulative housing and the shielding shell.

13 Claims, 8 Drawing Sheets

(56) References Cited

U.S. PATENT DOCUMENTS

| | | | | |
|---|---|---|---|---|
| 2013/0065442 | A1* | 3/2013 | Nagata | H01R 13/5202 439/607.58 |
| 2013/0183845 | A1* | 7/2013 | Tan | H01R 13/5202 439/271 |
| 2014/0087576 | A1* | 3/2014 | Kuo | H01R 13/5202 439/271 |
| 2014/0113497 | A1* | 4/2014 | Wang | H01R 13/52 439/660 |
| 2014/0127923 | A1* | 5/2014 | Kuo | H01R 13/5202 439/271 |
| 2014/0302709 | A1* | 10/2014 | Zhao | H01R 12/57 439/519 |
| 2015/0311636 | A1 | 10/2015 | Chang et al. | |
| 2016/0020560 | A1* | 1/2016 | Ju | H01R 24/78 439/607.05 |
| 2016/0141805 | A1* | 5/2016 | Zhao | H01R 13/504 439/607.01 |

* cited by examiner

WATERPROOF ELECTRICAL CONNECTOR

BACKGROUND OF THE INVENTION

1. Field of the Invention

The present invention relates to an electrical connector, and more particularly to an electrical connector with water resistance.

2. Description of Related Art

Universal Serial Bus (USB) and USB connectors are well known in the art. China Patent No. 203871583 discloses a reverse electrical connector. The electrical connector includes an insulative housing, a number of contacts, a metal case engaged with the insulative housing, and a shielding shell enclosing the insulative housing. The insulative housing includes a first insulative base, a second insulative base, and a third insulative housing. The third insulative housing defines a third insulative base and a tongue portion extending forwardly from the third base. The contacts include a number of first contacts retained in the first base and a number of second contacts retained in the second base. Each of the first contacts has a first contacting portion pendent from the first base and each of the second contacts has a second contacting portion pendent from the second base. There are a number of gaps between the first insulative base, the second insulative base, the third insulative housing and the contacts to cause fluid into the electrical connector to damage the contacts or contribute to failure to the contacts.

Hence, a new and simple electrical connector are desired.

SUMMARY OF THE INVENTION

Accordingly, the object of the present invention is to provide an electrical connector, mounted upon a printed circuit board, comprising: an insulative housing defining a third base portion and a groove located at an upper surface in a rear end; a plurality of terminals disposed in the insulative housing and having a plurality of first contacts and a plurality of second contacts, each first contact has a first soldering portion, each second contact has a second soldering portion; a shielding shell attached to the housing and defining a guiding hole; and a glue wall formed by glue flowing from the guiding hole through the groove to seal up a gap between the insulative housing and the shielding shell.

Other objects, advantages and novel features of the invention will become more apparent from the following detailed description when taken in conjunction with the accompanying drawings.

DETAILED DESCRIPTION OF THE PREFERRED EMBODIMENT

Figure 1:
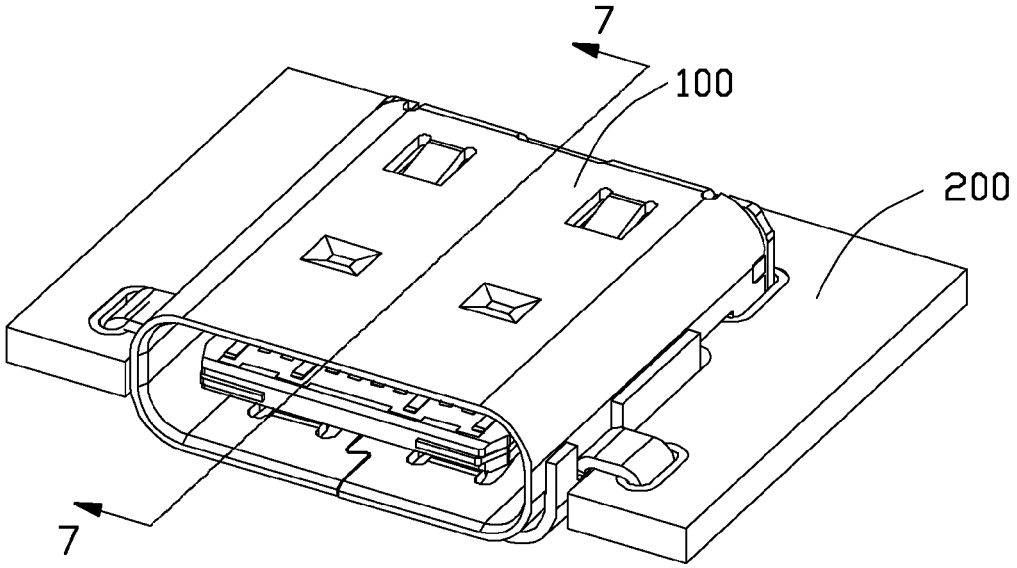
FIG. 1 is a perspective, assembled view of an electrical connector mounted upon a printed circuit board in a sink manner.
Figure 2:
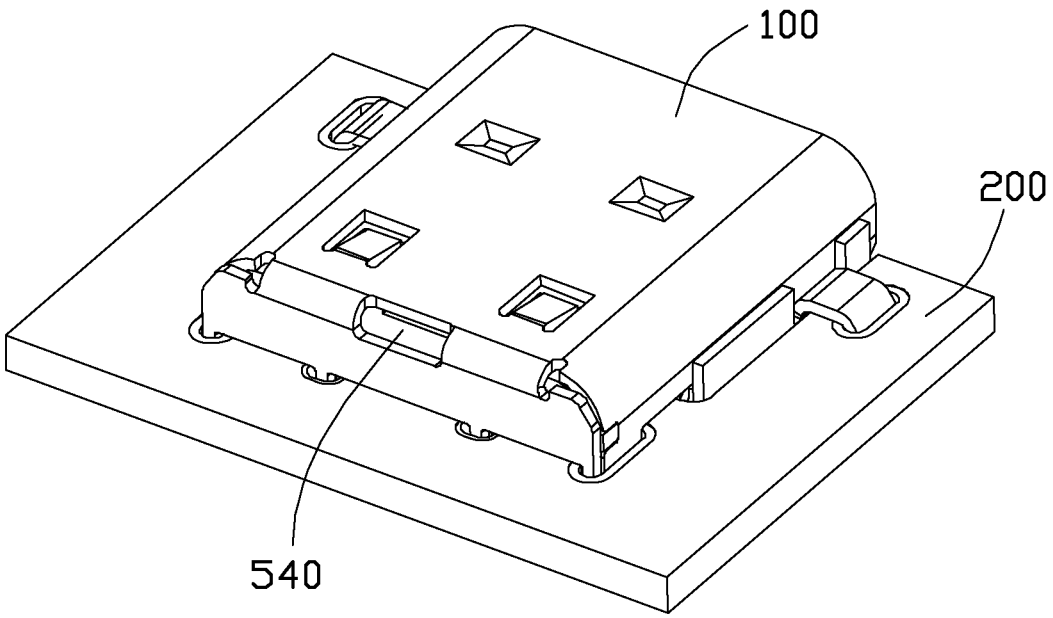
FIG. 2 is a another perspective, assembled view of the electrical connector mounted upon a printed circuit board in a sink manner.
Figure 3:
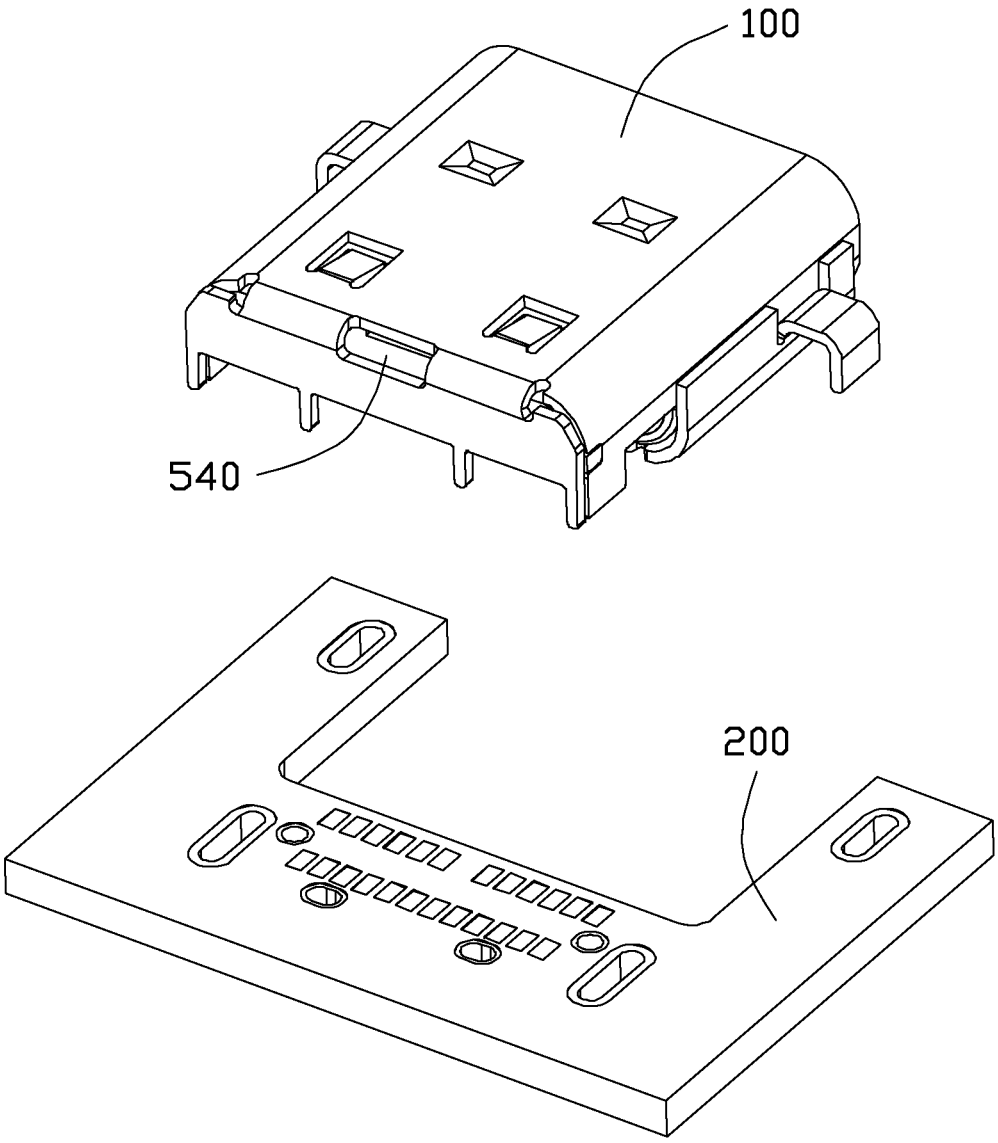
FIG. 3 is perspective view of the electrical connector separated with the printed circuit board of FIG. 2.

Reference will now be made in detail to the preferred embodiment of the present invention.

FIGS. 1-7 show an electrical connector 100, mounted upon a printed circuit board 200 in a sink manner, includes an insulative housing assembly 1, a number of terminals 2 and a metal sheet 3 retained in the insulative housing assembly 1, a glue wall 4 made of glue for water resistance, a shielding shell 5 formed with a mating cavity to receive the insulative housing assembly 1, and a metal shell 6 attached to the shielding shell 5. For convenience, an insertion direction, an up-and-down direction, and a left-to-right direction are defined.

Figure 4:
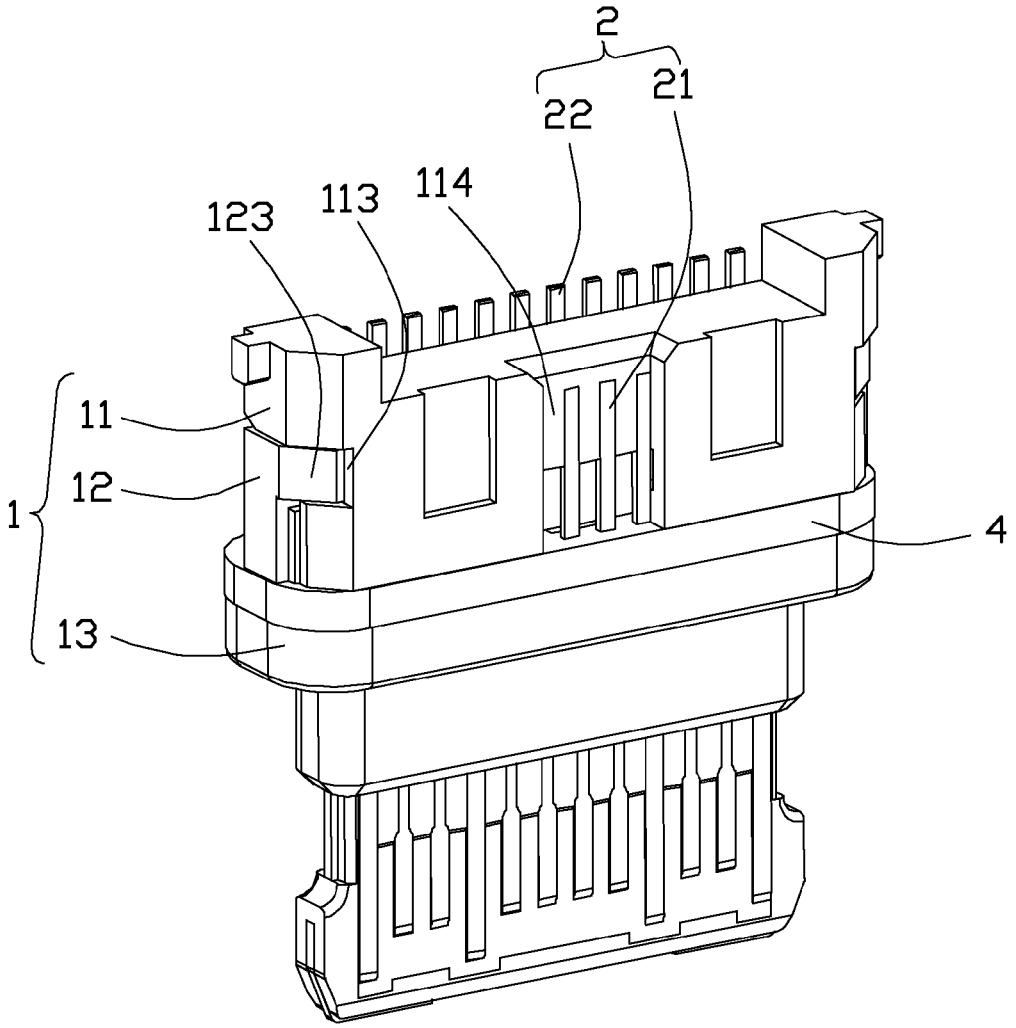
FIG. 4 is a perspective view of the electrical connector with no metal shell and no shielding shell.
Figure 4A:
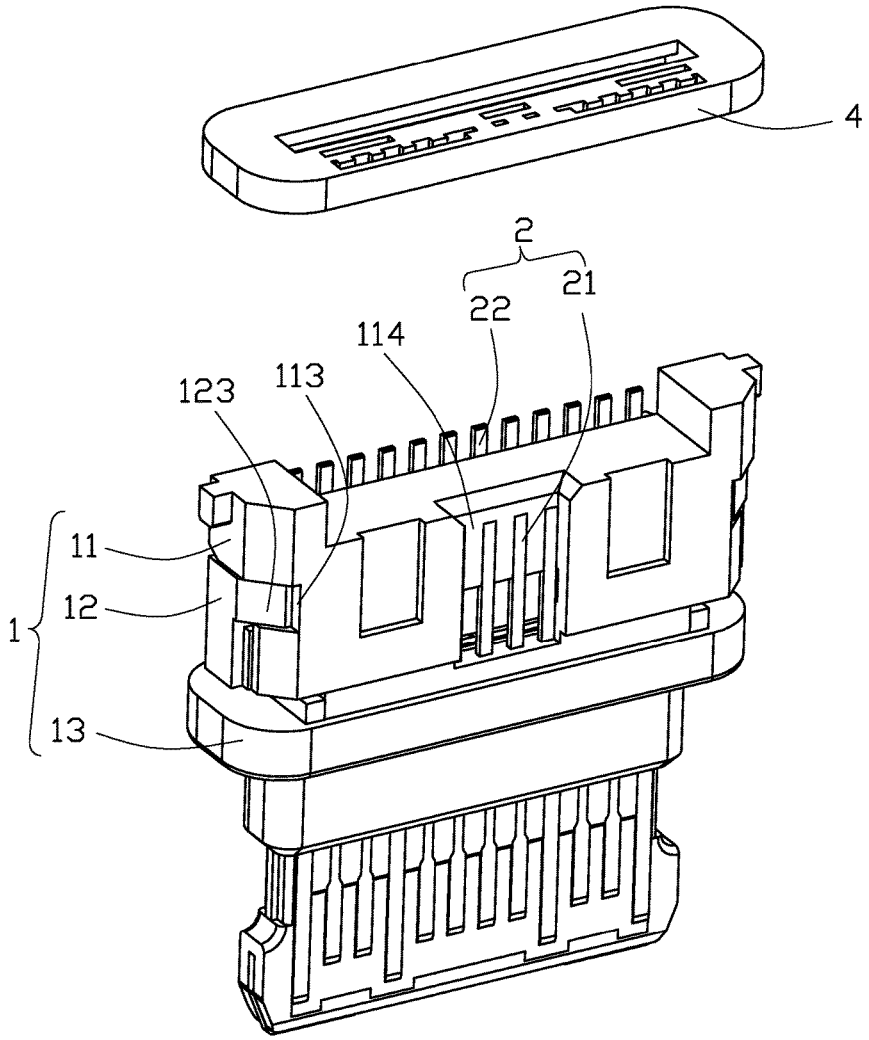
FIG. 4(A) is a perspective view of the electrical connector with no metal shell and no shielding shell and the glue wall is removed to show the corresponding circumferential groove structure in which the glue wall is disposed.
Figure 5:
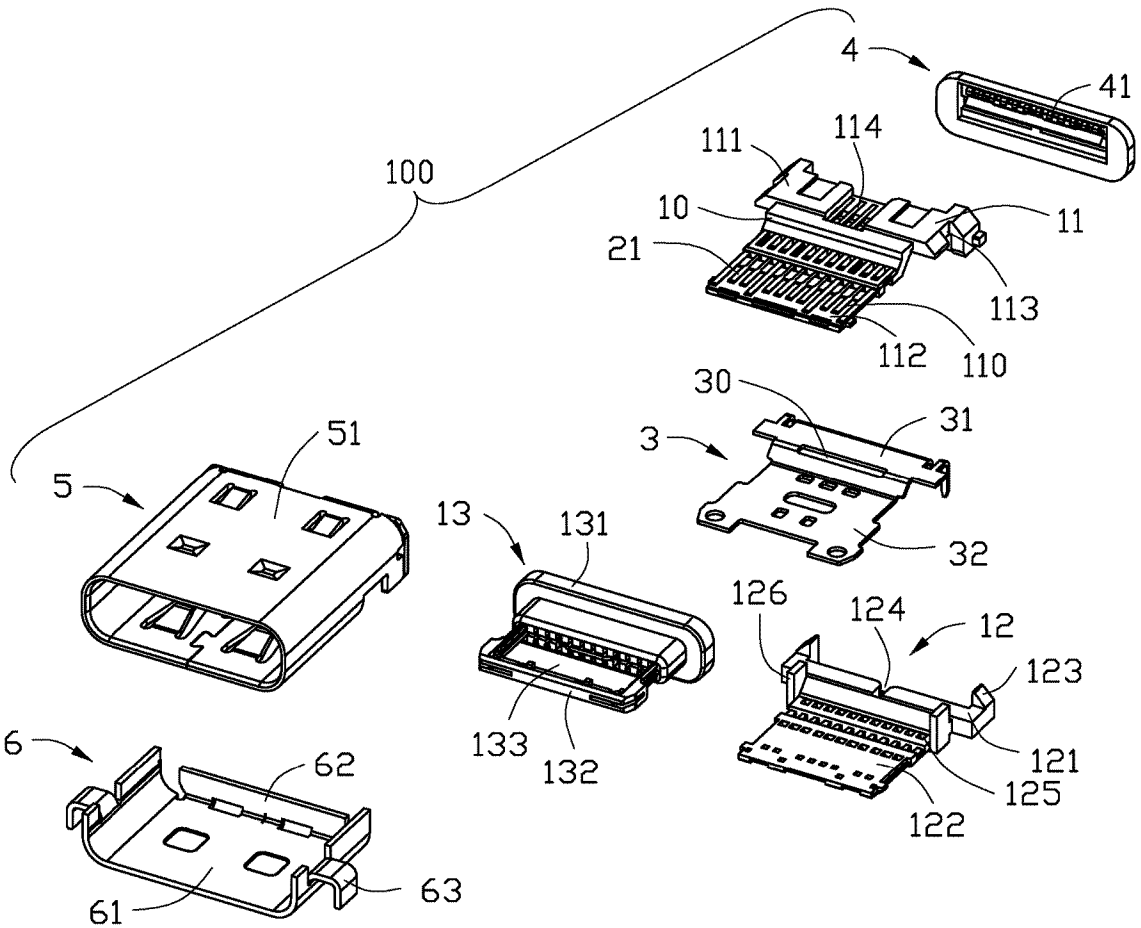
FIG. 5 is a perspective, exploded view of the electrical connector.
Figure 6:
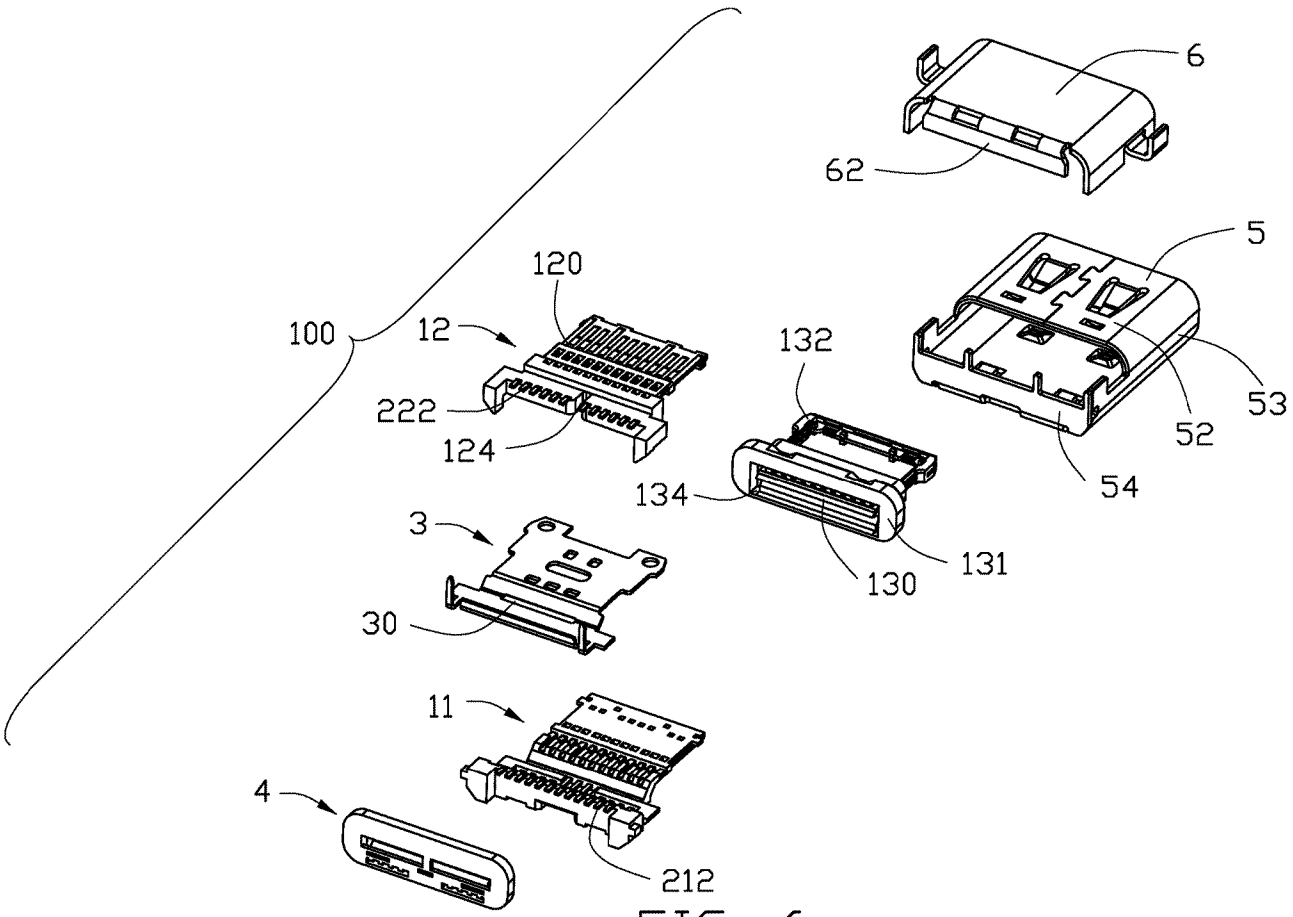
FIG. 6 is another perspective, exploded view of the electrical connector of FIG. 5.
Figure 7:
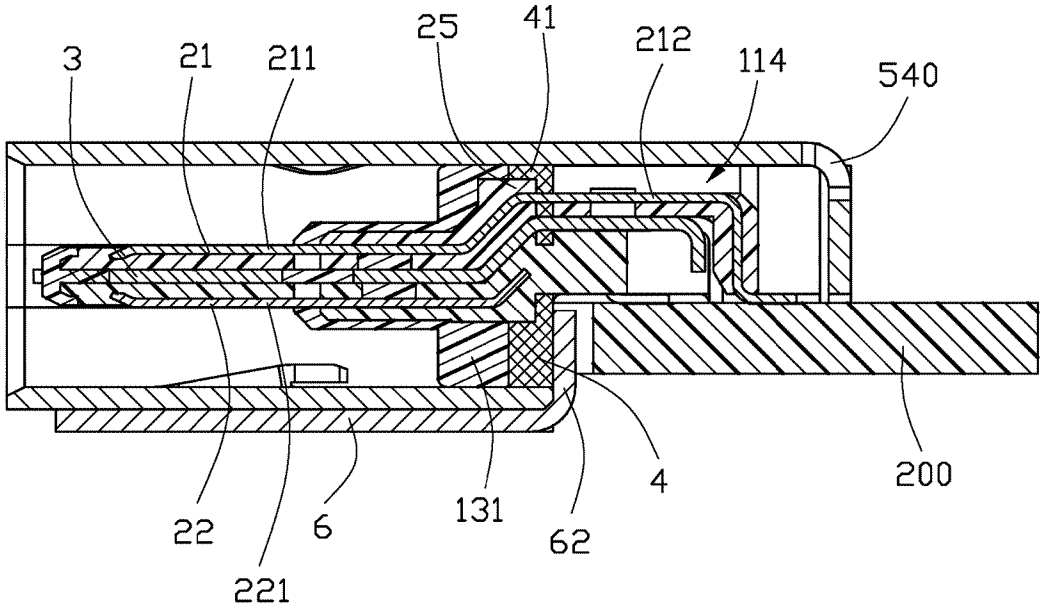
FIG. 7 is a cross-sectional view of the electrical connector along line 7-7 in FIG. 1.

Referring to FIGS. 4-6, the insulative housing assembly 1 includes a first insulative housing 11 and a second insulative housing 12 disposed in an up-and-down direction, and a third insulative housing 13 accommodating the first insulative housing 11 and the second insulative housing 12. The first insulative housing 11 includes a first base portion 111 and a first tongue portion 112 extending forwardly from the first base portion 111. The first base portion 111 defines a pair of depression 113 located at two sides thereof and a groove 114 located at an upper surface in a rear end and for receiving glue. The first tongue portion 112 has a number of first slots 110 extending in the insertion direction and a connecting portion 10 engaged with the first base portion 111. The second insulative housing 12 includes a second base portion 121 and a second tongue portion 122 extending forwardly from the second base portion 121. The second base portion 121 has a pair of projections 123 extending upwardly and locking the depression 113 of the first insulative housing 11, and a vacant portion 124 communicated therethrough. The second tongue portion 122 has a number of second slots 120 extending in the insertion direction, a number of apertures 125 located in a left-to-right direction, and a pair of projections 126 located at two sides of the connecting portion 10. The third insulative housing 13 including a third base portion 131 and a third tongue portion 132 extending forwardly from the third base portion 131. The third tongue portion 132 defines a hollow part 133. The third base portion 131 defines a insertion entrance 130 in a rear end, and a pair of receiving spaces 134 in two sides of the insertion entrance 130. The projections 126 are received in the receiving spaces 134 and glue walled by glue. An upper surface of the third base portion 131 is abreast of an upper surface of the first base portion 111 and a bottom surface of the third base portion 131 is abreast of a bottom surface of the first base portion 111.

Referring to FIGS. 4-7, the terminals 2 includes a number of first contacts 21 carried by the first tongue portion 112 and a number of second contacts 22 carried by the second tongue portion 122. The second contacts 22 are exposed from the apertures 125, and part of the first contacts 21 are exposed from the groove 114 before the glue wall 4 is formed. The first contacts 21 and the second contacts 22 extending in an insertion direction respectively includes four power contacts located forwardly and eight signal contacts located backwardly. The two power contacts in the middle are used to provide electric source and the other two are used for electrical grounding. The eight signal contacts includes four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Each of the first contacts 21 includes a first contacting portion 211 disposed in an upper surface of the first tongue portion 112 and a first soldering portion 212 extending from a back end of the first base portion 111. Each of the second contacts 22 includes a second contacting portion 221 disposed in a bottom surface of the second tongue portion 122 and a second soldering portion 222 extending from a back end of the second base portion 121. The first contacts 21 and the second contacts 22 are positioned to have 180 degree symmetry such that the corresponding plug connector can be inserted and operatively coupled to the electrical connector 100 in either of two orientations. The first soldering portion 212 and the second soldering portion 222 are located at a same plane and configured in two rows.

The metal sheet 3, shaping like a panel, is sandwiched between the first insulative housing 11 and the second insulative housing 12. The metal sheet 3 includes an affixed part 31 sandwiched between the first base portion 111 and the second base portion 121, and a supporting part 32 sandwiched between the first tongue portion 112 and the second tongue portion 122. The metal sheet has an opening 30 communicated with the vacant portion 124 of the second insulative housing 12 and the groove 114 of the first insulative housing 11 for flowing the glue.

The shielding shell 5 includes a top wall 51 and a bottom wall 52 located oppositely, a pair of side walls 53 connected with the top wall 51 and the bottom wall 52, and a rear wall 54 separated with the bottom wall 52. The rear wall 54 has a guiding hole 540 corresponding to the groove 114 of the insulative housing assembly 1 for flowing the glue.

The metal shell 6 includes a main part 61, a back part 62 extending downwardly from a rear end of the main part 61, and a pair of the soldering leg 63. The back part 62 shields after the third base portion 131. The soldering legs 63 are affixed to the printed circuit board 200.

The first insulative housing 11 and the second insulative housing 12 are respectively insert-molded, then assembled with the metal sheet 3. The third insulative housing 13 is over-molded with the first insulative housing 11, the metal sheet 3, and the second insulative housing 12 to orient the terminals 2 in a right way.

Referring to FIGS. 1-4, the electrical connector 100 is placed in the up-and-down/vertical direction and the guiding hole 540 is located at a higher lever after assembling, then the glue like glue is poured from the guiding holes 540 of the shielding shell 5 through the groove 114 of the first insulative housing 1 and the vacant portion 124 of the second insulative housing 2 to glue wall up a cavity between the insulative housing assembly 1 and the shielding shell 5 behind the third base portion 131 and an exposed part of the terminals 2 retained in the insulative housing 1. The cavity includes a room formed by the main part 61, back part 62, a rear surface of the third base portion 131, and a bottom surface of the second insulative housing 12. The glue wall 4 glue walls up spaces between the first insulative housing 11, the second insulative housing 12, the third insulative housing 13, and the shielding shell 5 to prevent fluid from entering into the electrical connector 100 to damaging the terminals 2. Notably, in this embodiment, the third base portion 131 defines a rear wall (of the housing) against which the glue wall 4 abuts. On the other hand, different from the traditional way, the glue wall no longer is of a simple planar structure abutting against the rear wall but further including a frame structure 41 (FIG. 7) in front of such a planar structure to surround the a rearward protruding section 25 (FIG. 7) commonly formed on the rear portions of both the first insulative housing 11 and the second insulative housing 12 in a circumferential manner, so as to be sandwiched between such a rearward protruding section and the metallic shell 6 generally radially. Technically speaking, the instant invention to provides an open path defined by the groove 114, the circumferential groove structure which forms the aforementioned frame structure 41 of the glue wall 4, and the vacant portion 124, so as to make a smooth flow of the injected glue for easy formation of the final shape of the glue wall 4. In other words, in this embodiment the first insulative housing 11, the second insulative housing 12 and the third insulative housing 13 are commonly regarded as an insulative housing assembly or structure which forms such a rearwardly protruding section 25 for result in the aforementioned circumferential groove structure for receiving the corresponding glue during forming such a glue wall 4.

However, the disclosure is illustrative only, changes may be made in detail, especially in matter of shape, size, and arrangement of parts within the principles of the invention.

What is claimed is:

1. An electrical connector for mounting upon a printed circuit board, comprising:

an insulative housing defining a base portion and a groove located at an upper surface of the base portion;

a plurality of terminals disposed in the insulative housing and having a plurality of first contacts and a plurality of second contacts, each first contact has a first soldering portion, each second contact having a second soldering portion;

a shielding shell attached to and enclosing outside the insulative housing and defining a guiding hole at a rear wall thereof in fluid communication with the groove, a cavity being defined between the insulative housing and the shielding shell and exposed rearwardly to be in fluid communication with the groove; and a glue wall formed in the cavity between the insulative housing and the shielding shell.

2. An electrical connector as claimed in claim 1, wherein:

the insulative housing has a rearwardly protruding section around a rear portion thereof in a front-to-back direction;

the shielding shell encloses the insulative housing circumferentially;

a circumferential groove structure is formed between the rearwardly protruding section and the shielding shell radially; and the glue wall applied around said rear portion and fills the circumferential groove structure to form a frame structure.

3. The electrical connector as claimed in claim 2, wherein said glue wall further includes a planar part sealing a rear of the insulative housing.

4. An electrical connector comprising:

an insulative housing structure forming a rearwardly protruding section around a rear portion thereof in a front-to-back direction;

a plurality of contacts disposed in the housing with corresponding tail sections extending rearwardly out of the rear portion;

a metallic shell enclosing the housing structure circumferentially;

a circumferential groove structure formed between the rearwardly protruding section and the shell radially; and a glue wall applied around said rear portion and filling the circumferential groove structure to form a frame structure; wherein said glue wall is forwardly spaced from a rear end face of said insulative housing structure, and rearwardly communicates, in said front-to-back direction, with an exterior outside of said metallic shell.

5. The electrical connector as claimed in claim 4, wherein the housing structure forms a groove along the front-to-back direction as a passage to communicate the circumferential groove with said exterior for glue injection use.

6. The electrical connector as claimed in claim 5, wherein said groove exposes the corresponding contacts in a vertical direction perpendicular to said front-to-back direction.

7. The electrical connector as claimed in claim 5, wherein said housing structure further includes a vacant portion opposite to the groove in a vertical direction perpendicular to said front-to-back direction.

8. The electrical connector as claimed in claim 4, wherein the shell includes a back part enclosing a rear face of the housing structure, and forms a guiding hole, around a corner of said back part, as a passage for glue injection use.

9. The electrical connector as claimed in claim 4, wherein said glue wall further includes a planar part sealing the housing structure along the front-to-back direction at least except tail sections of the corresponding contacts which extend rearwardly out of the glue wall.

10. An electrical connector comprising:

an insulative housing structure;

a plurality of contacts disposed in the housing structure with corresponding tail sections extending rearwardly out of a rear portion of the housing structure;

a metallic shell enclosing the housing structure circumferentially;

a groove formed in the housing structure and extending forwardly from a rear end face of the rear portion to function as a passage for glue injection use; and a glue wall formed in front of and forwardly spaced from the rear end face and extending circumferentially along an interior surface of the shell; wherein said groove forwardly directly communicates with said glue wall.

11. The electrical connector as claimed in claim 10, wherein said glue wall further seals a rearward face of the housing structure while tail sections of the contacts extend out of the glue wall.

12. The electrical connector as claimed in claim 10, wherein said groove communicates with the shell in a vertical direction perpendicular to said front-to-back direction.

13. The electrical connector as claimed in claim 10, further including a vacant portion in the housing assembly opposite to the groove in a vertical direction perpendicular to said front-to-back direction.

* * * * *